US010227955B1

(12) United States Patent
Duddu et al.

(10) Patent No.: US 10,227,955 B1
(45) Date of Patent: Mar. 12, 2019

(54) SYSTEM FOR EXHAUST GAS RECIRCULATION

(71) Applicant: GM GLOBAL TECHNOLOGY OPERATIONS LLC, Detroit, MI (US)

(72) Inventors: Srinivasa V. Duddu, Bangalore (IN); Rahul S. Raj, Bangalore (IN); Ravikumar S, Bangalore (IN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/910,078

(22) Filed: Mar. 2, 2018

(51) Int. Cl.

| | |
|---|---|
| ***F02M 26/31*** | (2016.01) |
| ***F02M 26/27*** | (2016.01) |
| ***F02M 26/30*** | (2016.01) |
| *F02M 26/04* | (2016.01) |

(52) U.S. Cl.
CPC ..... *F02M 26/31* (2016.02); *F02M 26/27* (2016.02); *F02M 26/30* (2016.02); *F02M 26/04* (2016.02)

(58) Field of Classification Search
CPC ..... F02M 26/31; F02M 26/30; F02M 26/27; F02M 26/04
See application file for complete search history.

(56) References Cited

U.S. PATENT DOCUMENTS

| | | | | |
|---|---|---|---|---|
| 6,173,701 | B1 | 1/2001 | Azuma | |
| 6,945,237 | B1 | 9/2005 | Sullivan et al. | |
| 8,201,442 | B2 * | 6/2012 | Osburn | F02D 41/0072 73/114.74 |
| 9,062,635 | B2 * | 6/2015 | Chi | F02D 41/0072 |
| 2006/0060171 | A1 | 3/2006 | Liu et al. | |

* cited by examiner

*Primary Examiner* — Hieu T Vo

(57) ABSTRACT

An exhaust gas recirculation system includes an intake manifold, an exhaust manifold, an EGR cooler, an EGR exhaust conduit and an EGR intake conduit having a diffuser. The intake manifold and the exhaust manifold are affixed to an engine head. The intake and exhaust manifolds are each in fluid communication with a plurality of combustion chambers defined by the engine head and an engine block. The EGR cooler includes a EGR cooler inlet and a EGR cooler outlet wherein the EGR exhaust conduit fluidly couples the exhaust manifold to the EGR cooler inlet. The EGR intake conduit includes a first end and a second end wherein the first end is affixed to the EGR cooler outlet and the second end is affixed to an intake passageway for the intake manifold. The diffuser includes a plurality of fins affixed to the second end and extending into the intake passageway.

14 Claims, 5 Drawing Sheets

SYSTEM FOR EXHAUST GAS RECIRCULATION

TECHNICAL FIELD

The present disclosure generally relates to internal combustion systems and more particularly, exhaust gas recirculation (EGR) systems for internal combustion engines.

BACKGROUND

Internal combustion engines convert chemical energy from a fuel into mechanical energy. The fuel may be petroleum-based (gasoline or diesel), natural gas, a combination thereof, or the like. Some internal combustion engines, such as gasoline engines, inject an air-fuel mixture into one or more cylinders for ignition by a spark from a spark plug or the like. Other internal combustion engines, such as diesel engines, compress air in the cylinder and then inject fuel into the cylinder for the compressed air to ignite. A diesel engine may use a hydraulically activated electronically controlled unit injection (HEUI) system or the like to control the fuel injection into the cylinders. The ignited fuel generates rapidly expanding gases that actuate a piston in the cylinder. Each piston usually is connected to a crankshaft or similar device for converting the reciprocating motion of the piston into rotational motion. The rotational motion from the crankshaft may be used to propel a vehicle, operate a pump or an electrical generator, or perform other work. The vehicle may be a truck, an automobile, a boat, or the like. The vehicle may be a truck, an automobile, a boat, or the like.

Many internal combustion engines use exhaust gases to reduce the production of nitrogen oxides (NOx) during the combustion process in the cylinders. These internal combustion engines typically mix a portion of the exhaust gases with the intake air for combustion in the cylinders. The exhaust gases usually lower the combustion temperature of the fuel below the temperature where nitrogen combines with oxygen to form NOx.

There are various approaches for mixing the exhaust gases with the intake air in an internal combustion engine. Some internal combustion engines control the opening and closing of exhaust and intake valves in a cylinder. The opening and closing of the valves may trap and push some exhaust gases from the cylinder into the intake manifold for mixing with the intake air. Other internal combustion engines use an exhaust gas recirculation (EGR) system to divert a portion of the exhaust gases exiting the cylinders for mixing with the intake air to the cylinders.

While the exhaust gases and intake air are combined, there may be an uneven dispersion of the exhaust gases in the intake air. The uneven dispersion may include pockets, zones, regions, or strata of higher or lower concentrations of exhaust gases than the selected concentration of exhaust gases in the intake air. The dispersion may be more uneven when the exhaust gases enter on one side of the intake air stream. The selected concentration of exhaust gases in the intake air may be reduced to avoid or reduce the effects of the uneven dispersion on engine operation. Internal combustion engines may produce more NOx at the lower selected concentrations of exhaust gases in the intake air.

Accordingly, there is a need for an exhaust gas recirculation system which better mixes the exhaust gases with the inlet air while also reducing the pressure drop as the air enters the intake manifold.

SUMMARY

The present disclosure provides an exhaust gas recirculation system which diverts a portion of the exhaust gases from the exhaust manifold to the intake manifold of the engine while evenly dispersing the exhaust airflow into the pressurized intake airflow for use in the combustion chambers. The exhaust gas recirculation system of the present disclosure may include an intake manifold, an exhaust manifold, an EGR cooler, an EGR exhaust conduit and an EGR intake conduit having a diffuser. The intake manifold and the exhaust manifold may be affixed to an engine head. The intake and exhaust manifolds may each be in fluid communication with a plurality of combustion chambers defined by the engine head and an engine block. The EGR cooler is configured to reduce the temperature of the exhaust airflow. The EGR cooler includes a EGR cooler inlet and a EGR cooler outlet wherein the EGR exhaust conduit fluidly couples the exhaust manifold to the EGR cooler inlet. The EGR intake conduit includes a first end and a second end wherein the first end is affixed to the EGR cooler outlet and the second end is affixed to an intake passageway for the intake manifold. The diffuser includes a plurality of fins affixed to the second end and extending into the intake passageway.

Each fin in the plurality of fins defines a plurality of apertures wherein each aperture in the plurality of apertures is configured to allow the exhaust airflow to pass through a fin to an adjacent fin. The plurality of fins includes an interior fin and an exterior fin. The interior fin is configured to engage with and disperse an exhaust airflow to at least one other fin in the plurality of fins and to a diffuser region across the intake passageway. The exterior fin is the outermost fin in the plurality of fins which further disperses exhaust airflow from at least the adjacent fin to the diffuser region.

An intermediate fin may be disposed between the interior fin and the exterior fin. It is understood that more than one intermediate fin may be implemented between the interior fin and the exterior fin. The intermediate fin(s), the interior fin, and the exterior fin may all be formed from one piece of material. The plurality of fins may be manufactured via a stamping or casting process such that each fin in the plurality of fins are integral to each other as shown. Alternatively, the plurality of fins may be welded to each other via joining members.

The present disclosure also provides for a vehicle engine having an improved EGR system. The vehicle engine includes an engine block, an engine head, an intake manifold, an exhaust manifold, an EGR cooler, an EGR exhaust conduit, and an EGR intake conduit. The engine block and the engine head define a plurality of combustion chambers wherein the engine head is affixed to the engine block. The intake manifold and the exhaust manifold may be affixed to the engine head such that intake and exhaust manifold are each in fluid communication with the plurality of combustion chambers. The EGR cooler is configured to reduce the temperature of the exhaust airflow and includes a EGR cooler inlet and a EGR cooler outlet. The EGR exhaust conduit is configured to fluidly couple the exhaust manifold to the EGR cooler inlet. The EGR intake conduit includes a first end and a second end wherein the first end of the EGR intake conduit may be affixed to the EGR cooler outlet and the second end of the EGR intake conduit may be affixed to an intake passageway for the intake manifold. The EGR intake conduit also includes a plurality of fins affixed to the second end which extend into the intake passageway.

Each fin in the plurality of fins defines a plurality of apertures which are configured to disperse the exhaust airflow and to enable exhaust airflow to move through one fin and to an adjacent fin. It is understood that the plurality of fins includes an interior fin and an exterior fin. The interior fin is configured to engage with and disperse an exhaust airflow to at least one other fin in the plurality of fins and to a diffuser region across the intake passageway. The exterior fin may be configured to further disperse exhaust airflow from at least one other fin in the plurality of fins to the diffuser region. The intermediate fin may be disposed between the interior fin and the exterior fin.

The present disclosure and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description, best mode, claims, and accompanying drawings in which:

Like reference numerals refer to like parts throughout the description of several views of the drawings.

DETAILED DESCRIPTION

Figure 1:
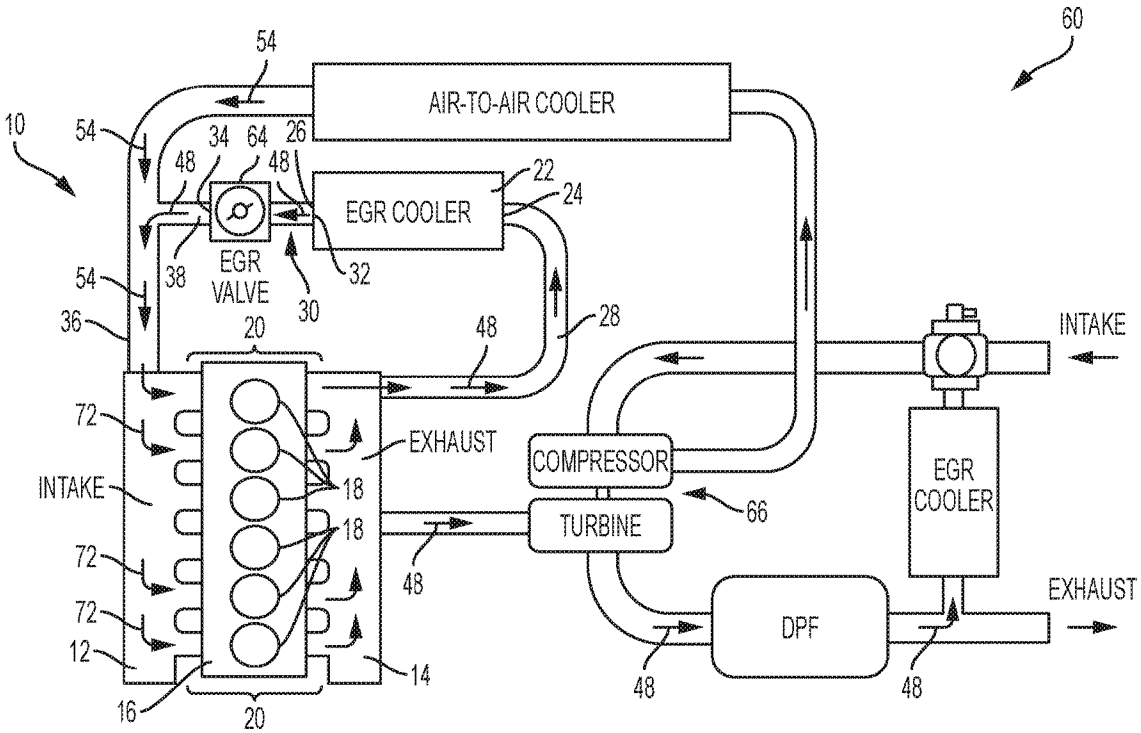
FIG. 1 is a schematic diagram of a vehicle engine having an exhaust gas recirculation (EGR) system.

Reference will now be made in detail to presently preferred compositions, embodiments and methods of the present disclosure, which constitute the best modes of practicing the present disclosure presently known to the inventors. The figures are not necessarily to scale. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

Except in the examples, or where otherwise expressly indicated, all numerical quantities in this description indicating amounts of material or conditions of reaction and/or use are to be understood as modified by the word "about" in describing the broadest scope of the present disclosure. Practice within the numerical limits stated is generally preferred. Also, unless expressly stated to the contrary: percent, "parts of," and ratio values are by weight; the description of a group or class of materials as suitable or preferred for a given purpose in connection with the present disclosure implies that mixtures of any two or more of the members of the group or class are equally suitable or preferred; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, unrecited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

The terms "comprising", "consisting of", and "consisting essentially of" can be alternatively used. Where one of these three terms is used, the presently disclosed and claimed subject matter can include the use of either of the other two terms.

Throughout this application, where publications are referenced, the disclosures of these publications in their entireties are hereby incorporated by reference into this application to more fully describe the state of the art to which this present disclosure pertains.

Referring now to FIG. 1, the exhaust gas recirculation (EGR) system of the present disclosure diverts a portion of the exhaust gases from the exhaust manifold 14 to the intake manifold 12 of the engine 60 while evenly dispersing the exhaust airflow 48 into the intake airflow 54 which passes through the diffuser region 52 (FIGS. 2 and 3) of the intake passageway. The diffuser region 52 is the section of the intake passageway 36 which includes and surrounds the diffuser 41. Thus, referring now to FIG. 1, an example, non-limiting exhaust gas recirculation system 10 of the present disclosure includes an intake manifold 12, an exhaust manifold 14, an EGR cooler 22, an EGR exhaust conduit 28 and an EGR intake conduit 30 having a diffuser 41.

As shown in FIG. 1, the intake manifold 12 and the exhaust manifold 14 are affixed to an engine head 16. The intake and exhaust manifolds 12, 14 are each in fluid communication with a plurality of combustion chambers 18 which are defined by the engine head 16 and an engine block 20. The EGR cooler 22 for the exhaust gas recirculation system 10 includes a EGR cooler inlet 24 and a EGR cooler outlet 26. The EGR cooler 22 for the exhaust gas recirculation system is configured to reduce the temperature of the exhaust airflow before the exhaust airflow enters the intake passageway. As shown in FIG. 1, the EGR exhaust conduit 28 fluidly couples the exhaust manifold 14 to the EGR cooler inlet 24. The EGR intake conduit 30 includes a first end 32 and a second end 34 wherein the first end 32 is affixed to the EGR cooler outlet 26 and the second end 34 is affixed to an intake passageway 36 for the intake manifold 12. The diffuser 41 includes a plurality of fins 38 affixed to the second end 34 and extending into the intake passageway 36.

The exhaust manifold 14 may be an accumulation chamber above the cylinders and affixed to the engine head 16 which gathers the exhaust gases for expulsion from the vehicle. The intake manifold 12 may be another chamber above the cylinders and affixed to the engine head 16 that holds a combustion gas for the cylinders. The combustion gas 72 may be all intake air or a combination of intake air 54 and exhaust gases 48 depending on the control signals which are sent to the EGR control valve (or throttle) 64. The amount of exhaust gases 48 in the combustion gas 72 may vary during engine operation in accordance with the engine's control system.

Figure 2:
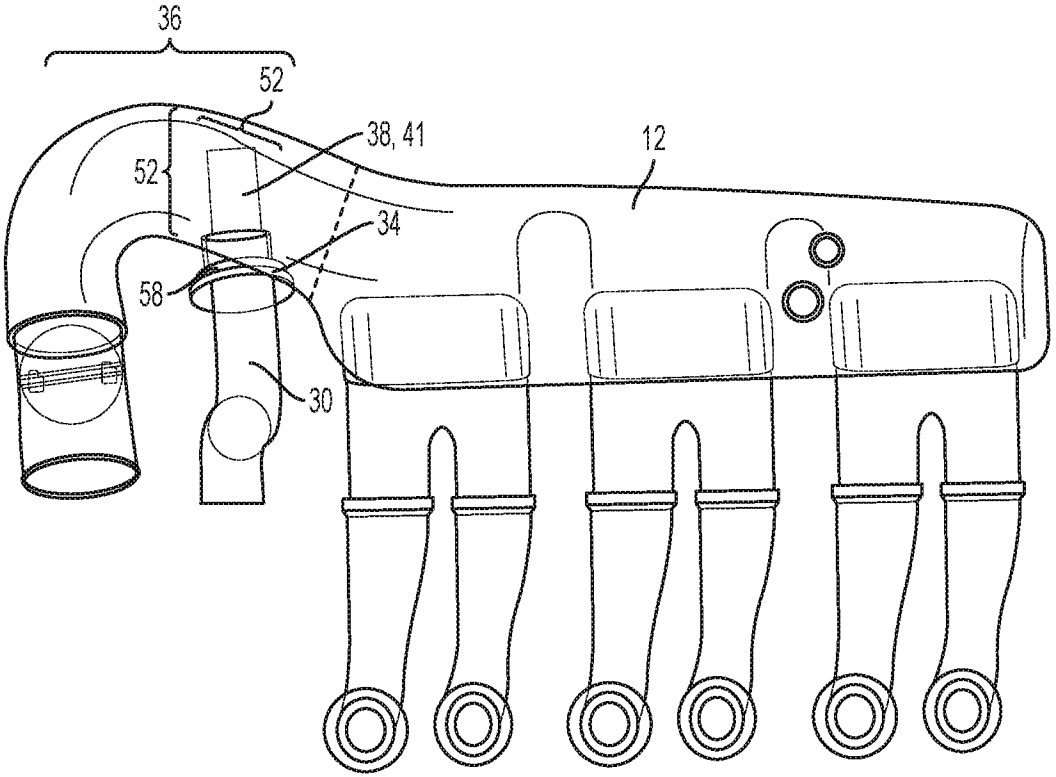
FIG. 2 is a side view of an example non-limiting intake manifold in accordance with various embodiments of the present disclosure.
Figure 3:
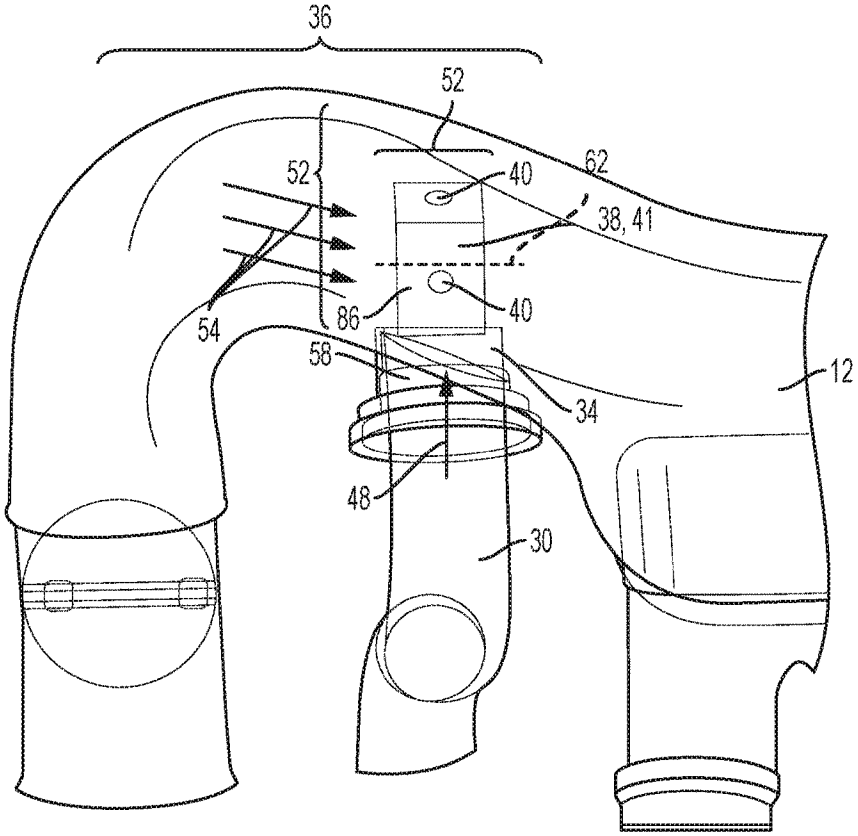
FIG. 3 is an example, non-limiting, enlarged side view of the inlet air passage for the intake manifold of FIG. 2.

Referring now to FIGS. 2 and 3, the diffuser 41 of the present disclosure extends into the intake passageway 36 and is configured to evenly distribute the hot exhaust gases 48 across the entire intake airflow 54 such that the combustion gas 72 may have an even distribution of exhaust gas 48 through the intake airflow 54. The diffuser 41 of the present disclosure is formed of a plurality of fins 38 the diffuser axis 62 as shown in FIG. 3 is substantially aligned with the flow path of the intake airflow 54 as shown in FIG. 3. That is, wide surface 86 of each fin 39 is substantially parallel to the intake airflow 54 as shown in FIG. 3. Accordingly, the intake airflow 54 is not disrupted as the intake airflow 54 passes by and through the diffuser 41 while also having the exhaust airflow 48 is dispersed throughout the intake airstream 54. Furthermore, as shown in FIGS. 2 and 3, the intake air passageway 36 may be defined by the intake manifold 12 such that the intake air passageway 36 is integral to the intake manifold 12. Alternatively, the intake air passageway 36 may be a separate component which is affixed to the intake manifold 12 as evidenced by the dashed lines in FIGS. 2 and 3.

Figure 4B:
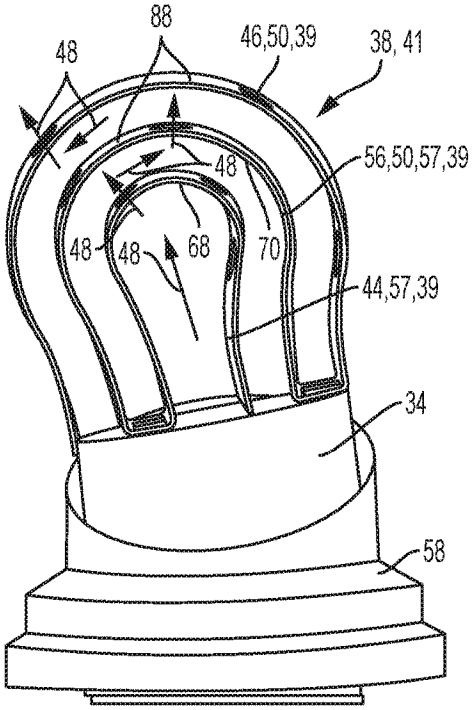
FIG. 4B is a front view of the example EGR diffuser in FIG. 4A affixed to a fitting.
Figure 4A:
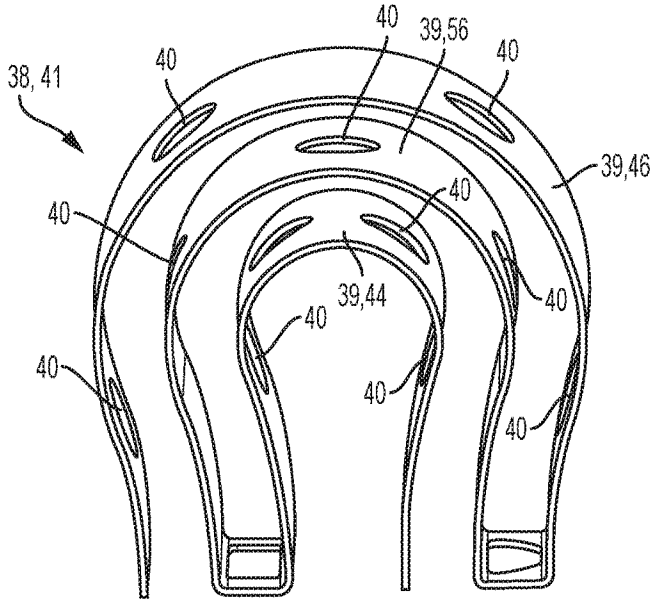
FIG. 4A is an example, non-limiting isometric view of a one-piece EGR diffuser which may be used in accordance with various embodiments of the present disclosure.
Figure 5:
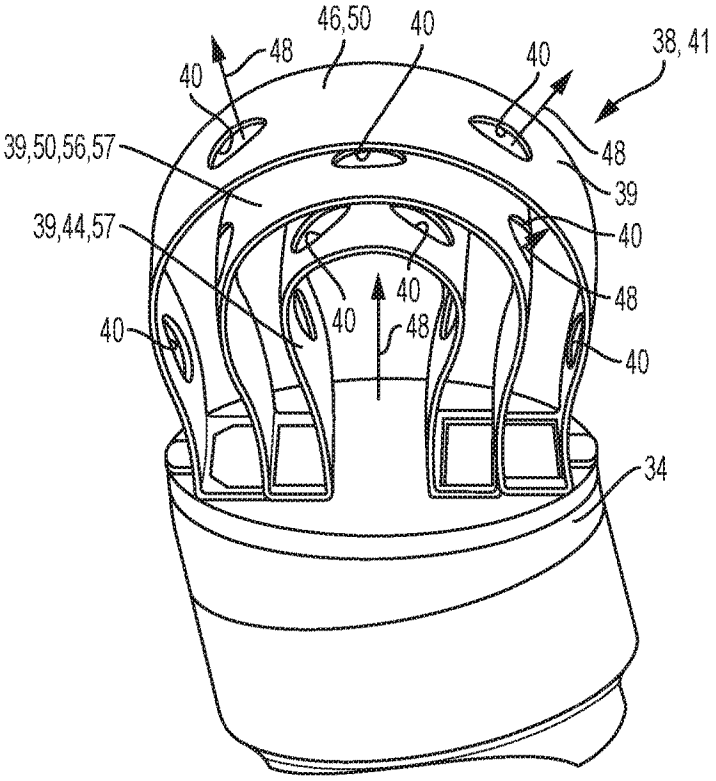
FIG. 5 is an example, non-limiting top view of a welded multi-piece EGR diffuser which may be used in accordance with various embodiments of the present disclosure.

Referring now to FIGS. 4A and 5, each fin 39 in the plurality of fins 38 defines a plurality of apertures 40 wherein each aperture 40 in the plurality of apertures 40 is configured to allow the exhaust airflow 48 to pass through a fin 39 to an adjacent fin 88. After the exhaust airflow 48 moves through an aperture 40 in a fin 39, the exhaust airflow 48 then engages with the adjacent fin 88 such that the exhaust airflow 48 is then dispersed by the adjacent fin 88 to the intake airflow 54 passing through the diffuser region 52 and through the apertures of the next outer fin 39. As shown, the apertures 40 in each fin 39 may be offset from the apertures 40 in the adjacent fin. Moreover, as shown, the plurality of fins 38 includes an interior fin 44 and an exterior fin 46. The interior fin 44 is configured to initially engage with and disperse an exhaust airflow 48 to at least one other fin 39 in the plurality of fins 38 and to a diffuser region 52 across the intake passageway 36. The exterior fin 46 is the outermost fin in the plurality of fins 38 which further disperses exhaust airflow 48 from at least the adjacent fin 39 to the diffuser region 52.

Referring now to FIGS. 4A-5, an intermediate fin 56 may be disposed between the interior fin 44 and the exterior fin 46. While FIGS. 4A-5 illustrate one intermediate fin 56, it is understood that more than one intermediate fin 56 may be implemented between the interior fin 44 and the exterior fin 46. The intermediate fin 56(s), the interior fin 44, and the exterior fin 46 may all be formed from one piece of material as shown in FIGS. 4A and 4B. The plurality of fins 38 may be manufactured via a stamping or casting process such that each fin 39 in the plurality of fins 38 are integral to each other as shown. Alternatively, the plurality of fins 38 may be welded to each other via joining members as shown in FIG. 5.

The plurality of fins 38 provide an open construction such that the intake airstream easily passes through the diffuser such that pressure drop across the diffuser is reduced. Thus, the upstream pressure (upstream of the diffuser) is substantially the same as the downstream pressure (downstream of the diffuser). In the region which is downstream of the diffuser, the velocity of the mixed air flow may be substantially the same of the velocity of the intake airflow 54 upstream of the diffuser given that the intake manifold 12 opening progressive increases in the region downstream of the diffuser. Moreover, the open construction of the diffuser does not disrupt the intake airstream and therefore, the velocity of the intake airstream is substantially maintained as the intake airstream passes through the diffuser. As is known, fluid velocity speed is inversely proportional to pressure and given that fluid velocity speed is maintained fore and aft of the diffuser, the upstream pressure and the downstream pressure are substantially the same such that a reduced pressure drop is experienced as the intake airstream passes through the diffuser.

As shown, the intake conduit may generally have a small diameter. This relatively smaller diameter increases the velocity of the intake air so that there is a relatively low pressure in the region of the diffuser. The relatively low pressure in the diffuser region 52 therefore increases the amount of exhaust gases that can enter into the intake conduit—given that the exhaust gases from the EGR intake conduit 30 may have a higher pressure than intake air pressure.

Therefore, the diffuser of the present disclosure evenly blends the exhaust airflow 48 with the intake airflow 54 without disrupting the velocity and pressure of the intake air flow. Accordingly, the combustion gas (formed by the mixture of intake air and exhaust gases) has a substantially uniform dispersion of the exhaust gases in the intake air. The uniform dispersion of the exhaust gases in the combustion gases sent to the cylinders ensures that the combustion engine produces NOx levels at or below target levels.

Referring back to the schematic diagram in FIG. 1, the present disclosure also provides for a vehicle engine 60 having an improved EGR system 10. The vehicle engine 60 includes an engine block 20, an engine head 16, an intake manifold 12, an exhaust manifold 14, an EGR cooler 22 for the EGR, an EGR exhaust conduit 28, and an EGR intake conduit 30. The engine block 20 and the engine head 16 define a plurality of combustion chambers 18 wherein the engine head 16 is affixed to the engine block 20. The intake manifold 12 and the exhaust manifold 14 may be affixed to the engine head 16 such that intake and exhaust manifold 14 are each in fluid communication with the plurality of combustion chambers 18. The EGR cooler 22 is configured to reduce the temperature of the exhaust airflow 48 and includes a EGR cooler inlet 24 and a EGR cooler outlet 26. The EGR exhaust conduit 28 is configured to fluidly couple the exhaust manifold 14 to the EGR cooler inlet 24. The EGR intake conduit 30 includes a first end 32 and a second end 34 wherein the first end 32 of the EGR intake conduit 30 may be affixed to the EGR cooler outlet 26 and the second end 34 of the EGR intake conduit 30 may be affixed to an intake passageway 36 for the intake manifold 12. The EGR intake conduit 30 also includes a plurality of fins 38 affixed to the second end 34 which extend into the intake passageway 36. The plurality of fins 38 may also be referenced as a diffuser herein.

As shown in FIGS. 4A and 5, each fin 39 in the plurality of fins 38 defines a plurality of apertures 40 which are configured to disperse the exhaust airflow 48 as shown in FIGS. 4B and 5. The plurality of fins 38 having a plurality of apertures 40 are configured to disperse the exhaust airflow 48 into the intersecting intake airflow 54. The plurality of apertures 40 enable exhaust airflow 48 to move through one fin 68 and to an adjacent fin 70 (FIG. 4B). Referring to FIGS. 4A-5, it is understood that the plurality of fins 38 includes an interior fin 44 and an exterior fin 46. The interior fin 44 is configured to engage with and disperse an exhaust airflow 48 to at least one other fin 50 (see FIGS. 4B and 5) in the plurality of fins 38 and to a diffuser region 52 (FIGS. 2 and 3) in the intake passageway 36. The exterior fin 46 may be configured to further disperse exhaust airflow 48 from at least one other fin 57 50 in the plurality of fins 38 to the diffuser region 52. The intermediate fin 56 may be disposed between the interior fin 44 and the exterior fin 46.

As shown in FIG. 1, the vehicle engine of the present disclosure and all embodiments of the present disclosure include an EGR exhaust conduit 28 which fluidly couples the exhaust gas manifold to the EGR cooler 22. The EGR exhaust conduit 28 may be a channel formed by the cylinder head or other engine component, a pipe or tube outside the cylinder head, a combination thereof, or the like. While not shown in FIG. 1, a gas trap may also be implemented with the EGR cooler 22 wherein the gas trap is configured to remove particulate from the exhaust gases. The EGR cooler 22 may be a heat exchanger or other device for removing heat from the exhaust gases. The EGR cooler 22 may use coolant from the engine cooling system, a separate cooling system, or a combination thereof. All embodiments of the present disclosure may also optionally have a pressure measurement device (not shown) to measure the exhaust gas flow through the EGR conduit.

The vehicle engine and the EGR system 10 of the present disclosure may, but not necessarily have a throttle or valve (shown in FIG. 1) disposed downstream of the EGR cooler 22 and upstream of the intake passageway 36. The engine controller or another microprocessor (not shown) may activate the control valve (or throttle) to adjust the flow of exhaust gases toward the intake manifold 12 to achieve a selected concentration of exhaust gases in the intake air. The selected concentration of exhaust gases may vary during engine operation. The control valve/throttle only when the pressure of the exhaust gases is higher than the pressure of the intake air.

Accordingly, all embodiments of the present disclosure include a diffuser formed by a plurality of fins 38 which is disposed at the connection of the EGR intake conduit 30 with the intake passageway 36 that supplies intake air for the cylinders. The plurality of fins 38 are arranged around the diffuser axis 62 wherein each fin 39 has a varying width as shown in FIG. 4B. The interior fin 44 may have the shortest width while the exterior fin 46 has the largest width. It is understood that the exterior fin 46 may have a width which may, but not necessarily, fall within a range of 60% to 95% of the diameter for the intake passageway 36.

It is understood that the EGR intake conduit 30 of all embodiments may further include an optional flange or fitting as shown in FIG. 4B. The flange or fitting shown in FIG. 4B may couple the EGR intake passageway 36 to the inlet passageway. In the event that a flange or fitting is not used, the EGR intake passageway 36 may be welded directly to the inlet passageway. With reference to the diffuser which is disposed at the second end 34 of the EGR intake conduit 30. The diffuser may, but not necessarily, be welded to the flange/fitting 58 as shown in FIG. 4B. The diffuser may alternatively, be welded directly to the inlet at the joint of the EGR intake conduit 30 and the inlet, or the diffuser may be directly welded to the EGR intake conduit 30.

The intake passageway 36 may be defined by the intake manifold 12 as shown in FIGS. 2 and 3, or the intake passageway 36 may be defined by the inlet air conduit (pipe or hose) which couples the compressor to the intake manifold 12. The inlet air conduit may be connected to the output of a compressor that pressurizes the intake air upstream of the diffuser. The diffuser of the present disclosure combines exhaust gases from the EGR intake conduit 30 with intake airflow 54 from the to form the combustion gas for the combustion cylinders. As indicated, during engine operation, the EGR throttle/control valve may, but not necessarily, allow specific amounts of the exhaust gases to flow into the intake airflow 54 when the pressure of the exhaust gases is greater than the pressure of the intake airflow 54. The intake air pressure may vary especially when the turbocharger is used.

The detailed description is merely exemplary in nature and is not intended to limit the present disclosure or the application and uses of the present disclosure. Furthermore, there is no intention to be bound by any theory presented in the preceding detailed description.

What is claimed is:

1. An exhaust gas recirculation system comprising:

an intake manifold and an exhaust manifold affixed to an engine head and each being in fluid communication with a plurality of combustion chambers defined by the engine head and an engine block;

an EGR cooler having a EGR cooler inlet and a EGR cooler outlet;

an EGR exhaust conduit configured to fluidly couple the exhaust manifold to the EGR cooler inlet; and an EGR intake conduit having a first end and a second end, the first end of the EGR intake conduit being affixed to the EGR cooler outlet and the second end of the EGR intake conduit being affixed to an intake passageway for the intake manifold, the EGR intake conduit further comprising a plurality of fins affixed to the second end and extending into the intake passageway.

2. The exhaust gas recirculation system as defined in claim 1 wherein each fin in the plurality of fins defines a plurality of apertures.

3. The exhaust gas recirculation system as defined in claim 2 wherein the plurality of fins includes an interior fin and an exterior fin.

4. The exhaust gas recirculation system as defined in claim 3 wherein the interior fin is configured to engage with and disperse an exhaust airflow to at least one other fin in the plurality of fins and to a diffuser region across the intake passageway.

5. The exhaust gas recirculation system as defined in claim 4 wherein the exterior fin is configured to further disperse the exhaust airflow from the at least one other fin in the plurality of fins to the diffuser region.

6. The exhaust gas recirculation system as defined in claim 5 further comprising an intermediate fin disposed between the interior fin and the exterior fin.

7. The exhaust gas recirculation system as defined in claim 6 wherein each aperture in the plurality of apertures is configured to allow the exhaust airflow to pass through a fin in the plurality of apertures to an adjacent fin.

8. A vehicle engine comprising:

an engine block defining a plurality of combustion chambers;

an engine head affixed to the engine block;

an intake manifold and an exhaust manifold affixed to the engine head and each being in fluid communication with the plurality of combustion chambers;

an EGR cooler having a EGR cooler inlet and a EGR cooler outlet;

an EGR exhaust conduit configured to fluidly couple the exhaust manifold to the EGR cooler inlet; and an EGR intake conduit having a first end and a second end, the first end of the EGR intake conduit being affixed to the EGR cooler outlet and the second end of the EGR intake conduit being affixed to an intake passageway for the intake manifold, the EGR intake conduit further comprising a plurality of fins affixed to the second end and extending into the intake passageway.

9. The vehicle engine as defined in claim 8 wherein each fin in the plurality of fins defines a plurality of apertures.

10. The vehicle engine as defined in claim 9 wherein the plurality of fins includes an interior fin and an exterior fin.

11. The vehicle engine as defined in claim 10 wherein the interior fin is configured to engage with and disperse an exhaust airflow to at least one other fin in the plurality of fins and to a diffuser region across the intake passageway.

12. The vehicle engine as defined in claim 11 wherein the exterior fin is configured to further disperse exhaust airflow from at least one other fin in the plurality of fins to the diffuser region.

13. The vehicle engine as defined in claim 12 further comprising an intermediate fin disposed between the interior fin and the exterior fin.

14. The vehicle engine as defined in claim 13 wherein each aperture in the plurality of apertures is configured to allow exhaust airflow to pass through a fin in the plurality of apertures to an adjacent fin.

* * * * *